United States Patent [19]

El-Sayed

[11] Patent Number: 4,977,056

[45] Date of Patent: Dec. 11, 1990

[54] ALKYLHYDROXY BENZYLPOLYAMINE AS ADJUVANT FOR ELECTROSTATIC LIQUID DEVELOPERS

[75] Inventor: Lyla M. El-Sayed, West Chester, Pa.

[73] Assignee: E. I. Du Pont de Nemours and Company, Wilmington, Del.

[21] Appl. No.: 83,185

[22] Filed: Aug. 10, 1987

[51] Int. Cl.[5] ..... G03G 9/12

[52] U.S. Cl. ..... 430/115; 252/403

[58] Field of Search ..... 430/115; 252/403

[56] References Cited

U.S. PATENT DOCUMENTS

| | | | |
|---|---|---|---|
| 3,362,907 | 1/1968 | Matkan et al. | 430/115 |
| 3,539,633 | 11/1970 | Piasek et al. | 260/570.5 |
| 3,909,433 | 9/1975 | Gilliams et al. | 430/115 X |
| 3,933,667 | 1/1976 | Machida et al. | 430/114 |
| 3,964,903 | 6/1976 | Van Besauw | 430/108 |
| 4,024,292 | 5/1977 | Lu et al. | 430/115 X |

*Primary Examiner*—J. David Welsh

[57] ABSTRACT

An electrostatic liquid developer consisting essentially of (A) nonpolar liquid having a Kauri-butanol value of less than 30, present in a major amount, (B) thermoplastic resin particles having an average by area particle size of less than 10 μm, (C) nonpolar liquid soluble ionic, nonionic, or zwitterionic compound, and (D) alkylhydroxybenzylpolyamine as define herein, being operably soluble in component (A) above.

Optionally colorant, adjuvants, etc., are present. The liquid electrostatic developer is useful in copying, making proofs including digital color proofs, lithographic printing plates, and resists.

30 Claims, No Drawings

ALKYLHYDROXY BENZYLPOLYAMINE AS ADJUVANT FOR ELECTROSTATIC LIQUID DEVELOPERS

TECHNICAL FIELD

This invention relates to an electrostatic liquid developer having improved properties. More particularly this invention relates to an electrostatic liquid developer containing as a constituent an alkylhydroxybenzylpolyamine.

BACKGROUND ART

It is known that a latent electrostatic image can be developed with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 $\mu$m average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound of the ionic, nonionic, or zwitterionic type and preferably a charge adjuvant such as a polyhydroxy compound, an aminoalcohol, polybutylene succinimide, aromatic hydrocarbon, metallic soap, etc. to the liquid toner comprising a thermoplastic resin, dispersant nonpolar liquid and preferably a colorant. Such liquid toners, while developing good quality images having high resolution with reduced wicking and squash, still do not provide the quality images required for certain end uses, e.g., optimum machine performance in digital color proofing. It has been found that some developer formulations suffer one or more of the following disadvantages which affect image quality: the image formed shows beading or flow and toner particle size is too large.

It has been found that the above disadvantages can be overcome and an improved electrostatic liquid developer prepared containing a nonpolar liquid, a thermoplastic resin, a nonpolar liquid soluble ionic, nonionic or zwitterionic compound, optionally a colorant, and the adjuvant compound of this invention. Such electrostatic liquid developer when used to develop an electrostatic image results in improved image quality, and solid area coverage independent of the charge director compound present.

DISCLOSURE OF THE INVENTION

In accordance with this invention there is provided an improved electrostatic liquid developer consisting essentially of (A) a nonpolar liquid having a Kauri-butanol value of less than 30, present in a major amount, (B) thermoplastic resin particles having an average by area particle size of less than 10 $\mu$m, (C) a nonpolar liquid soluble ionic, nonionic, or zwitterionic compound, (D) an alkylhydroxybenzylpolyamine having a benzyl amine group of the formula:

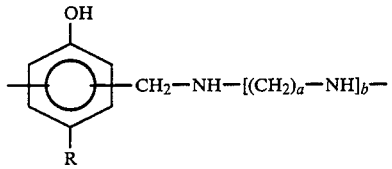

wherein a is 2–8, b is 1–10, and

R is an alkyl group of 1–20,000 carbon atoms, and being soluble in the nonpolar liquid.

Throughout the specification the below-listed terms have the following meanings:

In the claims appended hereto "consisting essentially of" means the composition of the electrostatic liquid developer does not exclude unspecified materials which do not prevent the advantages of the developer from being realized. Additional components, in addition to the primary components, include but are not limited to: colorants, fine particle size oxides, metals, adjuvant, e.g., polyhydroxy compound, amino-alcohol, polybutylene succinimide, aromatic hydrocarbon, quaternary ammonium hydroxide, etc.

Aminoalcohol means that there is both an amino and hydroxyl functionally in a single compound.

Flow means that large droplets show in the solid areas of the image and there is smearing of fine features.

Smooth means the absence of droplets and smearing of fine features in solids areas.

Beading means that there are large pools of toner in the solid areas of the image and breakage of lines in fine features.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C., Isopar®-M between 207° C. and 254° C., and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D 56. Isopar ®-L and Isopar ®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85.0 to 99.9% by weight, preferably 97.0 to 99.5% by weight, based on the total weight of the liquid developer. The total weight of solids in the liquid developer is 0.1 to 15%, preferably 0.5 to 3% by weight. The total weight of solids in the liquid developer is solely based on the resin, including components dispersed therein, e.g., pigment, adjuvant, etc.

Useful thermoplastic resins or polymers include: ethylene vinyl acetate (EVA) copolymers (Elvax ® resins, E. I. du Pont de Nemours and Company, Wilmington, DE), copolymers of ethylene and an $\alpha$, $\beta$-ethylenically unsaturated acid selected from the class consisting of acrylic acid and methacrylic acid, copolymers of ethylene (80 to 99.9%)/acrylic or methacrylic acid (20 to 0%)/alkyl ($C_1$ to $C_5$) ester of methacrylic or acrylic acid (0 to 20%), polyethylene, polystyrene, isotactic polypropylene (crystalline). ethylene ethyl acrylate series sold under the trademark Bakelite ® DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn ® ionomer resin by E. I. du Pont de Nemours and Company, Wilmington, DE, etc. Preferred copolymers are the copolymer of ethylene and an $\alpha$, $\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238 Procedure A. Particularly preferred copolymers of this type have an acid number of 66 and 60 and a melt index of 100 and 500 determined at 190° C., respectively.

In addition, the thermoplastic resins have the following preferred characteristics:

1. Be able to disperse the colorant, e.g., pigment; metallic soap, etc.
2. Be substantially insoluble in the dispersant liquid at temperatures below 40° C., so that the resin will not dissolve or solvate in storage,
3. Be able to solvate at temperatures above 50° C.,
4. Be able to be ground to form particles between 0.1 $\mu$m and 5 $\mu$m, in diameter,
5. Be able to form a particle (average by area) of less than 10 $\mu$m, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 to less than 10 $\mu$m, and a particle size cut of 1.0 $\mu$m.
6. Be able to fuse at temperatures in excess of 70° C.

By solvation in 3. above, the resins forming the toner particles will become softened or swollen, or gelatinous. The thermoplastic resin particles optionally may have a plurality of fibers integrally extending therefrom. The preparation of the resin particles is described below.

Suitable nonpolar liquid soluble ionic, nonionic, or zwitterionic compounds (C) include those compounds known in the art as agents that control the polarity of the charge on toner particles (charge directors). Examples of such compounds, which are generally used in an amount of 1 to 1000 mg/g, preferably 1 to 100 mg/g developer solids, are positive charge directors, e.g., ionic charge directors such as zirconium octoate, copper oleate, iron naphthenate, etc., and nonionic charge directors such as polyethylene glycol sorbitan stearate, etc.; negative charge directors, e.g., zwitterionic charge directors such as lecithin, etc., and ionic charge directors such as Basic Calcium Petronate ®, Basic Barium Petronte ® oil-soluble petroleum sulfonate, manufactured by Sonneborn Division of Witco Chemical Corp., New York, N.Y., etc.

The fourth component (D) of the electrostatic liquid developer is an alkylhydroxybenzylpolyamine having a benzyl amine group of the formula:

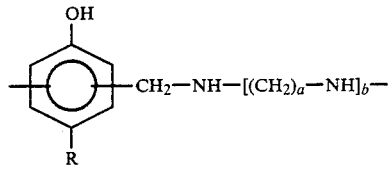

wherein a is 2–8, b is 1–10, and

R is an alkyl group of 1–20,000 carbon atoms.

The above benzyl amine groups (—PN—) are connected by methylene groups to form compounds such as H—PN—$CH_2$—PN—H, H—PN—$CH_2$—NP—H, H—PN—$CH_2$—NP—$CH_2$—PN—H, and the like. It is preferred that the alkylhydroxybenzylpolyamine has at least 50 or more carbon atoms. This copolymer is operably soluble in the nonpolar liquid. The hydroxy or amine of the alkylhydroxybenzylpolyamine can be further modified. For example, boron halides such as boron trifluoride, boron triiodide and boron trichloride can form an interaction product with the phenolic hydroxy groups, i.e., hydroxy group substituents on a benzene ring. Boron oxide, boron oxide hydrate, boron trifluoride, boron triiodide, boron tribromide, boron trichloride, boric acid, boronic acids (such as alkyl—B—$(OH)_2$ and aryl—B—$(OH)_2$), tetraboric acid, metaboric acid and esters of boric acids can form interaction products with other polar groups such as primary and secondary amino (—$NH_2$ and —NH) groups as well as phenolic hydroxy groups. Suitable such copolymers are commercially available compounds, e.g., copolymers sold by Amoco Petroleum Additives Co., Clayton, MO which may differ in molecular weight. Amoco 9250 which is said to have a number average molecular weight in the range of 1600 to 1800 and is made using Mannich chemistry. Amoco 595, and Amoco 9040 are believed to be made by a process similar to the one used to make Amoco 9250. Amoco 595 (sold as 45% surfactant, 30% aromatic hydrocarbon, and oil) and Amoco 9040 (sold as 40–45% surfactant, 36% aromatic hydrocarbon, and oil) have number average molecular weights of about 1000 and 1600 to 1800, respectively. The number average molecular weights can be determined by known osmometry techniques.

The alkylhydroxybenzylpolyamine is present in an amount of 0.01 to 10,000 mg/g of developer solids, preferably 0.1 to 1,000 mg/g of developer solids.

As indicated above, an additional component that can be present the electrostatic liquid developer is a colorant, such as pigments or dyes and combinations thereof, which are preferably present to render the latent image visible, though this need not be done in some applications. The colorant, e.g., a pigment, present in an amount up to about 60% by weight based on the weight of total solids in the liquid developer, preferably 0.01 to 50% by weight based on the weight of total solids in the liquid developer. The amount of colorant may vary depending on the use of the developer. Examples of pigments are Monastral® Blue G (C. I. Pigment Blue 15 C. I. No. 74160), Toluidine Red Y(C. I. Pigment Red 3), Quindo® Magenta (Pigment Red 122), Indo® Brilliant Scarlet (Pigment Red 123, C. I. No. 71145), Toluidine Red B (C. I. Pigment Red 3), Watchung® Red B (C. I. Pigment Red 48), Permanent Rubine F6B13-1731 (Pigment Red 184), Hansa® Yellow (Pigment Yellow 98), Dalamar® Yellow (Pigment Yellow 74, C. I. No. 11741), Toluidine Yellow G (C. I. Pigment Yellow 1), Monastral® Blue B (C. I. Pigment Blue 15), Monastral® Green B (C. I. Pigment Green 7), Pigment Scarlet (C. I. Pigment Red 60), Auric Brown (C. I. Pigment Brown 6), Monastral® Green G (Pigment Green 7), Carbon Black, Cabot Mogul L (black pigment C. I. No. 77266) and Sterling NS N 774 (Pigment Black 7, C. I. No. 77266).

Fine particle size oxides, e.g., silica, alumina, titania, etc., preferably of the order of 0.5 μm or less, can be dispersed into the liquefied resin. These oxides can be used alone or in combination with the colorants. Metal particles can also be added.

Another additional component of the liquid electrostatic developer is an adjuvant which can be selected from the group of polyhydroxy compound which contains at least 2 hydroxy groups, aminoalcohol, polybutylene succinimide, inorganic metal salt, metallic soap, quaternary ammonium hydroxides, and aromatic hydrocarbon having a Kauri-butanol value of greater than 30. The adjuvants are generally used in an amount of 1 to 1000 mg/g, preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol), pentaethylene glycol, tripropylene glycol, triethylene glycol, glycerol pentaerythritol, glyceroltri-12 hydroxystearate, ethylene glycol monohydroxystearate, propylene glycerol monohydroxystearate, etc.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc.

polybutylene succinimide: OLOA®-12 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

inorganic metal salts: salts wherein the cationic component is selected from the group consisting of metals of Group Ia, Group IIa, and Group IIIa of the periodic table, and wherein the anionic component of said salt is selected from the group consisting of halogen, carbonate, acetate, sulfate, borate, nitrate and phosphate. The inorganic metal salt is dispersed in the thermoplastic resin as described in El-Sayed U.S. application Ser. No. 014,710 filed Feb. 13, 1987, entitled "Inorganic Metal Salt as Adjuvant For Negative Liquid Electrostatic Developers, "now U.S. Pat. No. 4,758,494 the disclosure of which is incorporated herein by reference.

metallic soap: aluminum tristearate; aluminum distearate; barium, calcium, lead and zinc stearates; cobalt, manganese, lead and zinc linoleates; aluminum, calcium, and cobalt octoates; calcium and cobalt oleates; zinc palmitate; calcium, cobalt, manganese, lead and zinc naphthenates; calcium, cobalt, manganese, lead and zinc resinates; etc. The metallic soap is dispersed in the thermoplastic resin as described in Trout, U.S. application Ser. No. 857,326, filed Apr. 30, 1986, now U.S. Pat. No. 4,707,429 the disclosure of which is incorporated herein by reference.

quaternary ammonium hydroxide: tetraethylammonium hydroxide, tetrapropylammonium hydroxide, tetrabutylammonium hydroxide, etc.

aromatic hydrocarbon: benzene, toluene, naphthalene, substituted benzene and naphthalene compounds, e.g., trimethylbenzene, zylene, dimethylethylbenzene, ethylmethylbenzene, propylbenzene, Aromatic 100 which is a mixture of $C_9$ and $C_{10}$ alkyl-substituted benzenes manufactured by Exxon Corporation, etc.

The particles in the electrostatic liquid developer have an average by area particle size of less than 10 μm, preferably the average by area particle size is less than 5 μm. The resin particles of the developer may be formed having a plurality of fibers integrally extending therefrom. The term "fibers" as used herein means pigmented toner particles formed with fibers, tendrils, tentacles, threadlets, fibrils, ligaments, hairs, bristles, or the like.

The electrostatic liquid developer can be prepared by a variety of processes. For example, into a suitable mixing or blending vessel, e.g., attritor, heated ball mill, heated vibratory mill such as a Sweco Mill manufactured by Sweco Co., Los Angeles, Calif., equipped with particulate media, for dispersing and grinding, Ross double planetary mixer manufactured by Charles Ross and Son, Hauppauge, N.Y., or two roll heated mill (no particulate media necessary), etc., are placed at least one of the above-described nonpolar liquid and thermoplastic resin. Generally the resin, nonpolar liquid and optional colorant are placed in the vessel prior to starting the dispersing step. Optionally (1) the colorant can be added after homogenizing the resin and the nonpolar liquid, or (2) the colorant and alkylhydroxybenzylpolyamine can be homogenized, with or without nonpolar liquid, and added to the resin and nonpolar liquid mixture. Polar additive can also be present in the vessel, e.g., up to 100% based on the weight of polar additive and nonpolar liquid. The dispersing step is generally accomplished at elevated temperature, i.e., the temperature of ingredients in the vessel being sufficient to plasticize and liquefy the resin but being below that at which the dispersant nonpolar liquid or polar additive, if present, degrades and the resin, alkylhydroxybenzylpolyamine and/or colorant decomposes. A preferred temperature range is 80° to 120° C. Other temperatures outside this range may be suitable, however, depending on the particular ingredients used. The presence of the irregularly moving particulate media in the vessel is preferred to prepare the dispersion of toner particles. Other stirring means can be used as well, however, to prepare dispersed toner particles of proper size, configuration and morphology. Useful particulate media are particulate materials, e.g., spherical, cylindrical, etc. taken from the class consisting of stainless steel, carbon steel alumina, ceramic, zirconium, silica, and sillimantie. Carbon steel particulate media is particularly useful when colorants other than black are used. A typical diameter range for the particulate media is in the range of 0.04 to 0.5 inch (1.0 to ~13 mm).

Suitable polar liquids which have a Kauributanol value of at least 30 include: aromatic hydrocarbons of at least 6 carbon atoms, e.g., benzene, toluene, naphthalene, other substituted benzene and naphthalene compounds; monohydric, dihydric and trihydric alcohols of 1 to 12 carbon atoms and more, e.g., methanol, ethanol, butanol, propanol, dodecanol, etc., ethylene and other glycols, Cellosolve®; etc.

After dispersing the ingredients in the vessel, with or without a polar additive present until the desired dispersion is achieved, typically 1 to 2 hours, with the mixture being fluid, the dispersion is cooled, e.g., in the range of 0° C. to 50° C. Cooling may be accomplished, for example, in the same vessel, such as the attritor, while simultaneously grinding in the presence of additional liquid with particulate media to prevent the formation of a gel or solid mass; without stirring to form a gel or solid mass, followed by shredding the gel or solid mass and grinding, e.g., by means of particulate media in the presence of additional liquid; or with stirring to form a viscous mixture and grinding by means of particulate media in the presence of additional liquid. Optionally alkylhydroxybenzylpolyamine can be added at the beginning of or during the cooling process, with or without stirring, or it can be added during the grinding, shredding or stirring of the solid mass. Additional liquid means nonpolar liquid, polar liquid or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin solidifies or precipitates out of the dispersant during the cooling. Toner particles of average particle size (by area) of less than 10 μm, as determined by a Horiba CAPA-500 centrifugal particle analyzer described above or other comparable apparatus, are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant nonpolar liquid as described previously above. The dilution is normally conducted to reduce the concentration of toner particles to between 0.1 to 3 percent by weight, preferably 0.5 to 2 weight percent with respect to the dispersant nonpolar liquid. One or more nonpolar liquid soluble ionic, nonionic, or zwitterionic compounds, of the type set out above, are added to impart a positive or negative charge, as desired. The addition may occur at any time during the process; preferably at the end thereof, e.g., after the particulate media, if used, are removed and the concentration of toner particles is accomplished. If a diluting dispersant nonpolar liquid is also added, the ionic, nonionic, or zwitterionic compound can be added prior to, concurrently with, or subsequent thereto. An adjuvant compound of the type described above can be added at any time during the preparation of the developer. Preferably the adjuvant compound is added after the dispersing step. The alkylhydroxybenzylpolyamine polyamine can be added at any time during the process; preferably at the end of the process, e.g., after the particulate media, if used, are removed and the concentration of toner particles is accomplished; or during the cooling step.

INDUSTRIAL APPLICABILITY

The electrostatic liquid developers of this invention demonstrate improved image quality such as improved resolution, solid area coverage, toning of fine details and evenness of toning. The developers of this invention are useful in copying, e.g., making office copies of black and white as well as various colors; or color proofing, e.g., a reproduction of an image using the standard colors: yellow, cyan, magenta together with black as desired. In copying and proofing the toner particles are applied to a latent electrostatic image. Other uses are envisioned for the electrostatic liquid developers include: digital color proofing, lithographic printing plates, and resists (generally noncolored).

EXAMPLES

The following controls and examples wherein the parts and percentages are by weight illustrate but do not limit the invention. In the examples the melt indices were determined by ASTM D 1238, Procedure A, the average particle sizes by area were determined by a Horiba CAPA-500 centrifugal particle analyzer as described above, and the density was measured using a Macbeth densitometer model RD 918. The resolution is expressed in the Examples in line pairs/mm (1 p/mm).

EXAMPLE 1

In a Union Process 1-S Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Heucophthal Blue G XBT-583D Heubach, Inc., Newark, NJ | 14.0 |
| Dalamar ® yellow pigment YT-858D Heubach, Inc., Newark, NJ | 0.15 |
| Ethylene glycol (EG) | 13.3 |
| Isopar ®-L, nonpolar liquid having a Kauri-butanol value of 27, Exxon Corporation | 1000.0 |

The ingredients were heated to 100° C.±10° C. and milled with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, were added. Milling was continued for 22 hours to obtain toner particles with an average size of 1.64 μm by area. The particulate media were removed and the dispersion of toner particles was then diluted to 2.0 percent solids with additional Isopar ®-H. To 1500 grams of the developer was added 7.5 grams of a 10% solution of lecithin (purified grade, Fisher Scientific, Fair Lawn, N.J.). In Sample 1A nothing further was added. In Sample 1B, 50 grams of a 10% solution of Amoco 595 in Isopar ®-H was also added. Image quality was determined using a Savin 870 copier at standard mode: charging corona set at 6.8 kv and transfer corona set at 8.0 kv using as a carrier sheet Plainwell offset enamel paper number 3 gloss 60 lb. text, Plainwell Paper Co., Plainwell, Mich. The results are shown in Table 1 below.

EXAMPLE 2

In a Union Process 1-S Attritor, Union Process Company, Akron, Ohio, were placed the following ingredients:

| Ingredient | Amount (g) |
|---|---|
| Copolymer of ethyl (89%) and methacrylic acid (11%), melt index at 190° C. is 100, Acid No. is 66 | 200.0 |
| Quindo ® Magenta RV-6803 Mobay/Harmon | 50.0 |
| Indofast ® Brilliant Scarlet R-6300 Mobay/Harmon | 40.0 |
| Triisopropanolamine (TIPA) | 13.3 |
| Isopar ®-L, nonpolar liquid having a Kauri-butanol value of 27, Exxon Corporation | 1000.0 |

The ingredients were heated to 100° C.±10° C. and milled with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, were added. Milling was continued for 20 hours to obtain toner particles with an average size of 0.98 μm by area. The particulate media were removed and the dispersion of toner particles was then diluted to 2.0% percent solids with additional Isopar ®-H. The developer was charged with a 5.5% solution of Basic Barium Petronate ® oil-soluble petroleum sulfonate, Sonneborn Division of Witco Chemical Corp., New York, in the amount of 45 grams Basic Barium Petronate ®, oil-soluble petroleum sulfonate, Sonneborn Division of Witco Chemical Corp., New York, N.Y. to 1500 grams of developer. In Sample 2A nothing further was added. In Sample 2B 30 grams of a 10% solution of Amoco 595 was also added. Image quality was determined as described in Example 1. The results are shown in Table 1 below.

EXAMPLE 3

In a Union Process 1-S Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Heucophthal Blue GXBT-583D, Heubach, Inc., Newark, NJ | 15.1 |
| Ethylene glycol | 13.3 |
| Isopar ®-L, nonpolar liquid having a Kauri-butanol value of 27, Exxon Corporation | 1000.0 |

The ingredients were heated to 100° C.±10° C. and milled with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, were added. Milling was continued for 4.5 hours to obtain toner particles with an average size of 1.10 μm by area. The particulate media were removed and the dispersion of toner particles was then diluted to 2.0 percent solids with additional Isopar ®-H. To 2000 grams of the developer was added 23 grams of a 2.5% solution of lecithin in Isopar ®-H. In Sample 3A nothing further was added. In Sample 3B, 20 grams of a 10% solution of Amoco 9250 was also added. Image quality was determined as described in Example 1. The results are shown in Table 1 below.

EXAMPLE 4

In a Union Process 1-S Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Heucophthal Blue GXBT-583D, Heubach, Inc., Newark, NJ | 14.9 |
| Dalamar ® Yellow pigment YT-858D Heubach, Inc., Newark, NJ | 0.15 |
| Ethylene glycol | 13.3 |
| Isopar ®-L, nonpolar liquid having a Kauri-butanol value of 27, Exxon | 1000.0 |

-continued

| Ingredient | Amount (g) |
|---|---|
| Corporation | |

The ingredients were heated to 100° C.±10° C. and milled with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, were added. Milling was continued for 5 hours to obtain toner particles with an average size of 1.08 μm by area. The particulate media were removed and the dispersion of toner particles was then diluted to 2.0 percent solids with additional Isopar ®-H. To 1500 grams of this developer were added 6 grams of 10% lecithin solution in Isopar ®-H (Sample 4A). In Sample 4B 90 grams of a 10% solution of Amoco 9040 in Isopar ®-H were added. Image quality was determined as described in Example 1. The results are shown in Table 1 below.

EXAMPLE 5

In a Union Process 1-S Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, Acid No. is 66 | 200.0 |
| Quindo ® Magenta RV-6803 Mobay/Harmon | 18.5 |
| Indofast ® Brilliant Scarlet R-6300 Mobay/Harmon | 3.5 |
| Isopar ®-L, nonpolar liquid having a Kauri-butanol value of 27, Exxon Corporation | 1000.0 |

The ingredients were heated to 100° C.±10° C. and milled with 0.1875 inch (4.76 mm) diameter stainless steel balls for two hours. The attritor was cooled to room temperature while the milling was continued and then 700 grams of Isopar ®-H, nonpolar liquid having a Kauri-butanol value of 27, Exxon Corporation, were added. Milling was continued for 20 hours to obtain toner particles with an average size of 0.88 μm by area. The particulate media were removed and the dispersion of toner particles was then diluted to 2.0 percent solids with additional Isopar ®-H. To 2000 grams of this developer were added 30 grams of 10% 1M tetrabutylammonium hydroxide in a 1:10 methanol:toluene solution, and 30 grams of 2.5% lecithin in Isopar ®-H. The developer equilibrated eleven months and then an additional 5.5 grams of 10% lecithin solution in Isopar ®-H were added (Sample 5A). To Sample 5B were also added 60 grams of 10% solution of Amoco 595 in Isopar ®-H. Image quality was determined as described in Example 1 with the exception that the charging corona was set at 8.0 kv. The results are shown in Table 1 below.

EXAMPLE 6

In a Union Process 01 Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, Acid No. is 66 | 35.0 |
| Quindo ® Magenta RV-6803 Mobay/Harmon | 10.5 |
| Indofast ® Brilliant Scarlet R-6300 Mobay/Harmon | 7.0 |
| Isopar ®-L, nonpolar liquid having a Kauri-butanol value of 27, Exxon Corporation | 125.0 |
| Triisopropanolamine | 2.35 |

The ingredients were heated to 100° C.±10° C. and milled at a rotor speed of 230 rpm with 0.1875 inch (4.76 mm) diameter stainless steel balls for two hours. The attritor was cooled to room temperature while the milling was continued and then 125 grams of Isopar ®-H, nonpolar liquid having a Kauri-butanol value of 27, Exxon Corporation, were added. Milling was continued at a rotor speed of 330 rpm for 20 hours to obtain toner particles with an average size of 1.28 μm by area. The particulate media were removed and the dispersion of toner particles was then diluted to 1.0 percent solids with additional Isopar ®-H. To 1500 grams of this developer was added 26 grams of a 5.5 percent solution of Basic Barium Petronate ®, oil-soluble petroleum sulfonate, Sonneborn Division of Witco Chemical Corp. New York, in Isopar ®-H (Sample 6A). To Sample 6B was also added 20 grams of Amoco 9250. Image quality was determined as described in Example 1. The results are shown in Table 1 below.

EXAMPLE 7

In a Union Process 01 Attritor, Union Process Company, Akron, Ohio, were placed the following ingredients:

| Ingredient | Amount (g) |
|---|---|
| Copolymer of ethylene (89%) and methacrylic acid (11%), melt index at 190° C. is 100, Acid No. is 66 | 35.0 |
| Sterling NS, Cabot, Boston, MA | 3.5 |
| Isopar ®-L, nonpolar liquid having a Kauri-butanol value of 27, Exxon Corporation | 125.0 |

The ingredients were heated to 100° C.±10° C. in the attritor and milled with 0.1875 inch (4.76 mm) diameter stainless steel balls for two hours. The attritor was cooled to room temperature while the milling was continued and then 80 grams of Isopar ®-L, nonpolar liquid having a Kauri-butanol value of 27, Exxon Corporation, were added. Milling was continued for 6.75 hours to obtain toner particles with an average size of 1.48 μm by area. The particulate media were removed and the dispersion of toner particles was then diluted to 1.0 percent solids with additional Isopar ®-L. To 2000 grams of the developer were added 14 grams of 5.5% Basic Barium Petronate ®, in Isopar ®-L. In Sample 7A nothing was added. Sample 7B was prepared in the same manner described above in this example except that with the 80 grams of Isopar ®-L nonpolar liquid added to the cooled attritor were 15 grams of Amoco 9040, Amoco Petroleum Additives Co., Clayton, Mo. After 1 hour and 6 hours of milling, 5 grams of additional Amoco 9040 were added at each time. Milling was then continued for 0.75 hour to obtain toner particles with an average size of 0.85 μm by area. After removal of the particulate media and the dispersion of toner particles was diluted to 1.0 percent solids with additional Isopar®-L, to 2000 grams of the developer was added 46 grams of 5.5% Basic Barium Petronate® in Isopar®-L. Image quality was determined as described in Example 1. The results are shown in Table 1 below.

TABLE 1

| Samp. | Ch Dir | Adj. | Ad-dit. | Reso-lu-tion | Dens | Trans-fer Effi-ciency (%) | Solid Area |
|---|---|---|---|---|---|---|---|
| 1A | Lec | EG | none | 2.5 | 0.68 | 62 | flow |
| 1B | Lec | EG | 595 | 6.3 | 2.18 | 84 | smooth |
| 2A | BaPet | TIPA | none | 11.0 | 0.14 | 73 | flow |
| 2B | BaPet | TIPA | 595 | 12.5 | 0.83 | 89 | smooth |
| 3A | Lec | EG | none | 5.6 | 1.60 | 50 | flow |
| 3B | Lec | EG | 9250 | 10.0 | 1.55 | 99 | smooth |
| 4A | Lec | EG | none | 4.5 | 0.39 | 17 | flow |
| 4B | Lec | EG | 9040 | 10.0 | 1.94 | 72 | smooth |
| 5A | Lec | TBAOH | none | 7.1 | 1.5 | 76 | flow |
| 5B | Lec | TBAOH | 595 | 8.0 | 1.73 | 88 | smooth |
| 6A | BaPet | TIPA | none | 11.0 | 1.64 | 73 | flow |
| 6B | BaPet | TIPA | 9250 | 11.0 | 1.28 | 87 | smooth |
| 7A | BaPet | none | none | 9.0 | 0.98 | 85 | smooth |
| 7B | BaPet | none | 9040 | 11.0 | 0.90 | 85 | smooth |

The abbreviations in Table 1 above have the indicated meaning:
Lec is lecithin
BaPet is Basic Barium Petronate® oil-soluble petroleum sulfonate
EG is ethylene glycol
TBAOH is tetrabutylammonium hydroxide
TIPA is triisopropanolamine
595 is Amoco 595
9250 is Amoco 9250
9040 is Amoco 9040

I claim:

1. An electrostatic liquid developer consisting essentially of
   (A) a nonpolar liquid having a Kauri-butanol value of less than 30, present in a major amount,
   (B) thermoplastic resin particles having an average by area particle size of less than 10 μm,
   (C) a nonpolar liquid soluble charge director selected from the group consisting of ionic, nonionic, and zwitterionic compounds,
   (D) an alkylhydroxybenzylpolyamine having a benzyl amine group of the formula:

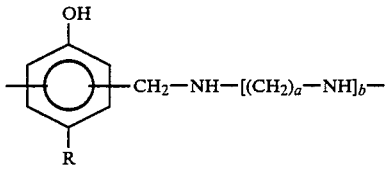

wherein
   a is 2–8,
   b is 1–10, and
   R is an alkyl group of 1–20,000 carbon atoms, being soluble in the nonpolar liquid.

2. An electrostatic liquid developer according to claim 1 wherein the alkylhydroxybenzylpolyamine has at least 50 carbon atoms.

3. An electrostatic liquid developer according to claim 2 wherein Component (D) is an alkylhydroxybenzylpolyamine having a number average molecular weight of about 1000.

4. An electrostatic liquid developer according to claim 2 wherein Component (D) is an alkylkydroxybenzylpolyamine having a number average molecular weight of about 1600 to 1800.

5. An electrostatic liquid developer according to claim 1 wherein component (D) is present in an amount of 0.01 to 10,000 mg/g of developer solids.

6. An electrostatic liquid developer according to claim 1 wherein the thermoplastic resin is a copolymer of ethylene and an α, β-ethylenically unsaturated acid and methacrylic acid.

7. An electrostatic liquid developer according to claim 1 wherein the thermoplastic resin is an ethylene vinyl acetate copolymer.

8. An electrostatic liquid developer according to claim 1 wherein the thermoplastic resin is a copolymer of ethylene (80 to 99.9%)/acrylic or methacrylic acid (20 to 0%)/alkyl ester of acrylic or methacrylic acid wherein alkyl is 1 to 5 carbon atoms (0 to 20%).

9. An electrostatic liquid developer according to claim 8 wherein the thermoplastic resin is a copolymer of ethylene (89%)/methacrylic acid (11%) having a melt index at 190° C. or 100.

10. An electrostatic liquid developer according to claim 1 wherein the particles have an average by area particle size of less than 5 μm.

11. An electrostatic liquid developer according to claim 1 wherein component (C) is an oil-soluble petroleum sulfonate.

12. An electrostatic liquid developer according to claim 1 wherein component (C) is lecithin.

13. An electrostatic liquid developer consisting essentially of
   (A) a nonpolar liquid having a Kauri-butanol value of less than 30, present in a major amount,
   (B) thermoplastic resin particles having an average by area particle size of less than 10 μm,
   (C) a nonpolar liquid soluble ionic, nonionic, or zwitterionic compound,
   (D) an alkylhydroxybenzylpolyamine having a benzyl amine group of the formula:

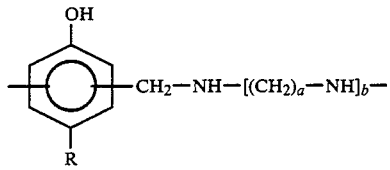

wherein a is 2–8,
   b is 1–10, and
   R is an alkyl group of 1–20,000 carbon atoms, being soluble in the nonpolar liquid; and
   (E) an adjuvant selected from the group consisting of polyhydroxy compound, amino-alcohol, polybutylene succinimide, inorganic metal salt, metallic soap, quaternary ammonium hydroxide and aromatic hydrocarbon, with the proviso that when the inorganic metal salt or metallic soap as present each is dispersed in thermoplastic resin component (B).

14. An electrostatic liquid developer according to claim 13 wherein the adjuvant is a polyhydroxy compound.

15. An electrostatic liquid developer according to claim 14 wherein the polyhydroxy compound is ethylene glycol.

16. An electrostatic liquid developer according to claim 13 wherein the adjuvant is an aminoalcohol.

17. An electrostatic liquid developer according to claim 16 wherein the aminoalcohol is triisopropanolamine.

18. An electrostatic liquid developer according to claim 13 wherein the adjuvant is a quaternary ammonium hydroxide.

19. An electrostatic liquid developer according to claim 18 wherein the quaternary ammonium hydroxide is tetrabutylammonium hydroxide.

20. An electrostatic liquid developer according to claim 13 wherein the adjuvant is polybutylene succinimide.

21. An electrostatic liquid developer according to claim 13 wherein the adjuvant is an inorganic metal salt dispersed in resin component (B).

22. An electrostatic liquid developer according to claim 13 wherein the adjuvant is a metallic soap dispersed in resin component (B).

23. An electrostatic liquid developer according to claim 13 wherein the adjuvant is an aromatic hydrocarbon.

24. An electrostatic liquid developer according to claim 1 containing up to about 60% by weight of a colorant based on the total weight of developer solids, the colorant being dispersed in the resin particles.

25. An electrostatic liquid developer according to claim 24 wherein the colorant is a pigment.

26. An electrostatic liquid developer according to claim 25 wherein the pigment is present an amount of 0.01 to 50% by weight based on the total weight of developer solids.

27. An electrostatic liquid developer according to claim 24 wherein the colorant is a dye.

28. An electrostatic liquid developer according to claim 1 wherein a fine particle size oxide is present.

29. An electrostatic liquid developer consisting essentially of:

(A) a nonpolar liquid having a Kauri-butanol value of less than 30, 85.0 to 99.9% by weight based on the weight of the developer;

(B) particles having an average by area particle size less than 10 μm of a copolymer of ethylene (89%)/methacrylic acid (11%) having a melt index at 190° C. of 100 wherein a plurality of fibers integrally extend from said particles;

(C) oil-soluble petroleum sulfonate, 1 to 1000 mg/g developer solids;

(D) an alkylhydroxybenzylpolyamine having a benzyl amine group of the formula:

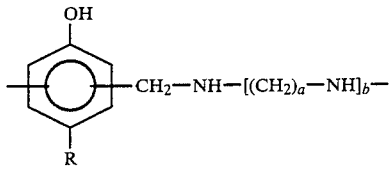

wherein a is 2–8, b is 1–10, and R is an alkyl group of 1–20,000 carbon atoms, being soluble in the nonpolar liquid, 0.01 to 10,000 mg/g developer solids; and (E) a black, cyan, magenta or yellow colorant, 0.01 to 60% by weight based on the total weight of developer solids.

30. An electrostatic liquid developer according to claim 29 wherein the oil-soluble petroleum sulfonate is replaced with a like amount of lecithin.

* * * * *